US009032767B2

(12) United States Patent
Takahashi

(10) Patent No.: US 9,032,767 B2
(45) Date of Patent: May 19, 2015

(54) LOCKABLE BUCKLE

(71) Applicant: YKK Corporation, Tokyo (JP)

(72) Inventor: Yoshinobu Takahashi, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 14/260,752

(22) Filed: Apr. 24, 2014

(65) Prior Publication Data

US 2014/0317893 A1 Oct. 30, 2014

(30) Foreign Application Priority Data

Apr. 26, 2013 (JP) ..... 2013-093577

(51) Int. Cl.

| | |
|---|---|
| ***E05B 73/00*** | (2006.01) |
| ***A44B 11/25*** | (2006.01) |
| ***E05B 65/00*** | (2006.01) |
| ***A44B 11/26*** | (2006.01) |

(52) U.S. Cl.

CPC ..... *A44B 11/2546* (2013.01); *Y10T 24/45094* (2015.01); *E05B 65/00* (2013.01); *A44B 11/2573* (2013.01); *A44B 11/266* (2013.01)

(58) Field of Classification Search

CPC ..... E05B 39/00; E05B 17/2034; E05B 19/00; E05B 19/0082

USPC ..... 70/14, 18, 57, 58; 24/614, 615, 625, 24/167

See application file for complete search history.

(56) References Cited

U.S. PATENT DOCUMENTS

| | | | | |
|---|---|---|---|---|
| 4,825,515 | A * | 5/1989 | Wolterstorff, Jr. | 24/625 |
| 4,912,950 | A * | 4/1990 | Crowle | 70/58 |
| 5,117,663 | A * | 6/1992 | Ida | 70/64 |
| 5,144,725 | A * | 9/1992 | Krauss | 24/625 |
| 5,419,020 | A * | 5/1995 | Murai | 24/625 |
| 5,551,131 | A * | 9/1996 | Anscher | 24/614 |
| 5,845,376 | A * | 12/1998 | Tung | 24/625 |
| 5,855,057 | A * | 1/1999 | Anscher | 24/614 |
| 5,873,505 | A * | 2/1999 | Sovitski | 224/576 |
| 6,000,109 | A * | 12/1999 | Anscher | 24/614 |
| 6,061,883 | A * | 5/2000 | Uehara | 24/625 |
| 6,154,936 | A * | 12/2000 | Howell et al. | 24/625 |
| 6,170,133 | B1 * | 1/2001 | Uehara | 24/614 |
| 6,408,494 | B1 * | 6/2002 | Anscher | 24/625 |
| 6,446,314 | B1 * | 9/2002 | Anscher | 24/614 |
| 6,622,355 | B2 * | 9/2003 | Buscart et al. | 24/615 |
| 6,647,750 | B2 * | 11/2003 | Kaneko et al. | 70/58 |
| 6,871,517 | B2 * | 3/2005 | Bonelli et al. | 70/58 |
| 7,089,633 | B2 * | 8/2006 | Liu | 24/615 |
| 7,107,657 | B1 * | 9/2006 | Howell | 24/614 |
| 7,181,936 | B2 | 2/2007 | Christensen et al. | |
| 7,513,020 | B2 * | 4/2009 | Giampavolo | 24/625 |
| 7,559,126 | B2 * | 7/2009 | Giampavolo | 24/625 |
| 7,895,719 | B2 * | 3/2011 | Woods | 24/625 |
| 8,418,327 | B2 * | 4/2013 | Woods | 24/625 |
| 8,522,410 | B2 * | 9/2013 | Parisi et al. | 24/634 |

(Continued)

*Primary Examiner* — Suzanne Barrett

(74) *Attorney, Agent, or Firm* — Kilpatrick Townsend & Stockton LLP

(57) ABSTRACT

There is provided a lockable buckle including a male member, a female member and a key member. A front surface portion of the female member is formed with a key member insertion hole communicating with an accommodation space. When the key member inserted into the accommodation space through the key member insertion hole is operated, the key member elastically deform engaging portions of the male member to release engagement between the engaging portions and engaged portion of the female member.

7 Claims, 13 Drawing Sheets

(56) References Cited

U.S. PATENT DOCUMENTS

| | | | | |
|---|---|---|---|---|
| 2002/0014096 | A1* | 2/2002 | Kaneko et al. | 70/58 |
| 2003/0121130 | A1* | 7/2003 | Buscart et al. | 24/615 |
| 2004/0112098 | A1* | 6/2004 | Bonelli et al. | 70/58 |
| 2005/0210641 | A1* | 9/2005 | Giampavolo | 24/615 |
| 2006/0053600 | A1* | 3/2006 | Liu | 24/615 |
| 2006/0243006 | A1* | 11/2006 | Christensen et al. | 70/58 |
| 2007/0226967 | A1* | 10/2007 | Woods | 24/625 |
| 2009/0100652 | A1* | 4/2009 | Mok | 24/625 |
| 2011/0209311 | A1* | 9/2011 | Woods | 24/625 |

* cited by examiner

LOCKABLE BUCKLE

CROSS-REFERENCE TO RELATED APPLICATIONS

This application is based on and claims priority from Japanese Patent Application No. 2013-093577 filed on Apr. 26, 2013 and the disclosure thereof, including specification, drawings and claims is incorporated herein by reference in its entirety.

TECHNICAL FIELD

The present invention relates to a lockable buckle which includes a male member and a female member which can be engaged with and disengaged from each other.

BACKGROUND

As a related-art buckle which detachably connects two objects that are to be connected, Patent Document 1 discloses a buckle which can be locked in the state in which a male member and a female member are connected to each other. The related-art buckle includes a male member having a pair of engaging portions, a female member having an engaged portion with which the engaging portions of the male member are engaged so as to connect the male and female members to each other, and a lock member which is provided in the female member. The lock member is positioned between the engaging portions of the male member, and selectively prevents or allows the disengaging operation of the engaging portions. In the male member, the engaging portions each having an operation portion are positioned at sides. The female member has operation openings in a pair of sides through which the operation portions positioned at the sides are exposed. As for the connection and disconnection of the buckle, the engaging portions are disengaged from the engaged portion when the operation portion of the male member is pressed in the connected state. The lock member has an elliptical shape, and is configured such that a position where the engaging portions of the male member are allowed to swing to a disengaging position and a position where the engaging portions of the male member are prevented from swinging to the disengaging position are selectable depending on the direction of the long axis of the ellipse.

Patent Document 1: U.S. Pat. No. 7,181,936

The buckle disclosed in Patent Document 1 has problems in that the lock member is attached to the female member as a separate part and that there is a great number of parts. In addition, since the lock member is provided as a separate member, the fabrication and assembly processes of the buckle are complicated, and the fabrication cost of the buckle is expensive. Furthermore, since the lock member is accommodated inside the female member, it is difficult to reduce the thickness of the female member. In a variety of situations of use, the buckle protruding from the surface of a member to which the buckle is attached frequently became an obstacle and the appearance was not undesirable.

SUMMARY

It is therefore an object of the present invention to provide a lockable buckle which has a reduced number of parts, is easy to have a thin and small profile, and can be fabricated at a low cost.

According to an aspect of the embodiments of the present invention, there is provided a lockable buckle comprising a male member, a female member and a key member, the male member and the female member being connectable to and disconnectable from each other, wherein the male member is formed with an attachment portion which is attachable to an external member and engaging portions protruding from the attachment portion, wherein the female member is formed with an attachment portion which is attachable to an external member and an accommodation space which is surrounded by a front surface portion, a back surface portion and side surface portions and configured to accommodate the engaging portions, wherein one end portion of the accommodation space is provided as an opening configured to insert the male member thereinto, wherein an engaged portion configured to engage the engaging portions therewith is provided inside the accommodation space, wherein the front surface portion of the female member is formed with a key member insertion hole communicating with the accommodation space, wherein the key member is configured to be inserted into the accommodation space through the key member insertion hole to abut to the engaging portions and to release engagement between the engaging portions and the engaged portion, and wherein the key member is configured to elastically deform the engaging portions to release the engagement between the engaging portions and the engaged portion when the key member inserted into the key member insertion hole is operated.

The key member may comprise insertion piece portions which is insertable into the accommodation space through the key member insertion hole and is configured to abut to the engaging portions when the key member pivots to push and expand the pair of engaging portions in a right and left direction.

The male member may be integrally formed with guide portions positioned outside the engaging portions in an engaged state.

The engaging portions and the guide portions may form a plate-shaped fitting body, the female member may be formed into a flat-shape and the accommodation space configured to fit the fitting body thereinto may be formed into a flat-shape.

Claw portions of the engaged portion may be engageable with groove portions formed in the pair of engaging portions at a side of a leading end portion of the engaging portions and groove portions formed in the engaging portions at a side of a base end portion, so that the male member and the female member are connectable to each other at at least two positions.

The attachment portion of the male member may be a belt attachment portion which is attachable to a belt, and in a state in which the male member is connected to the female member, edge portions of the front surface portion and the back surface portion of the female member may cover a part of the bet attachment portion.

When the male member is connected to the female member at the side of the leading end portion of the engaging portions, the belt attachment portion may not be covered with the female member, and when the male member is connected to the female member at the side of the base end portion, the part of the belt attachment portion may be covered with the edge portions of the female member.

According to the aspect of the embodiments of the present invention, it is possible to reduce the number of parts and it is easy to realize a small and thin profile since the female member of the lockable buckle can have an integral structure. It is possible to reduce cost, and the connected state is not released inadvertently. Accordingly, a high-safety buckle can be provided at a low price.

DETAILED DESCRIPTION OF THE EMBODIMENTS

Figure 1:
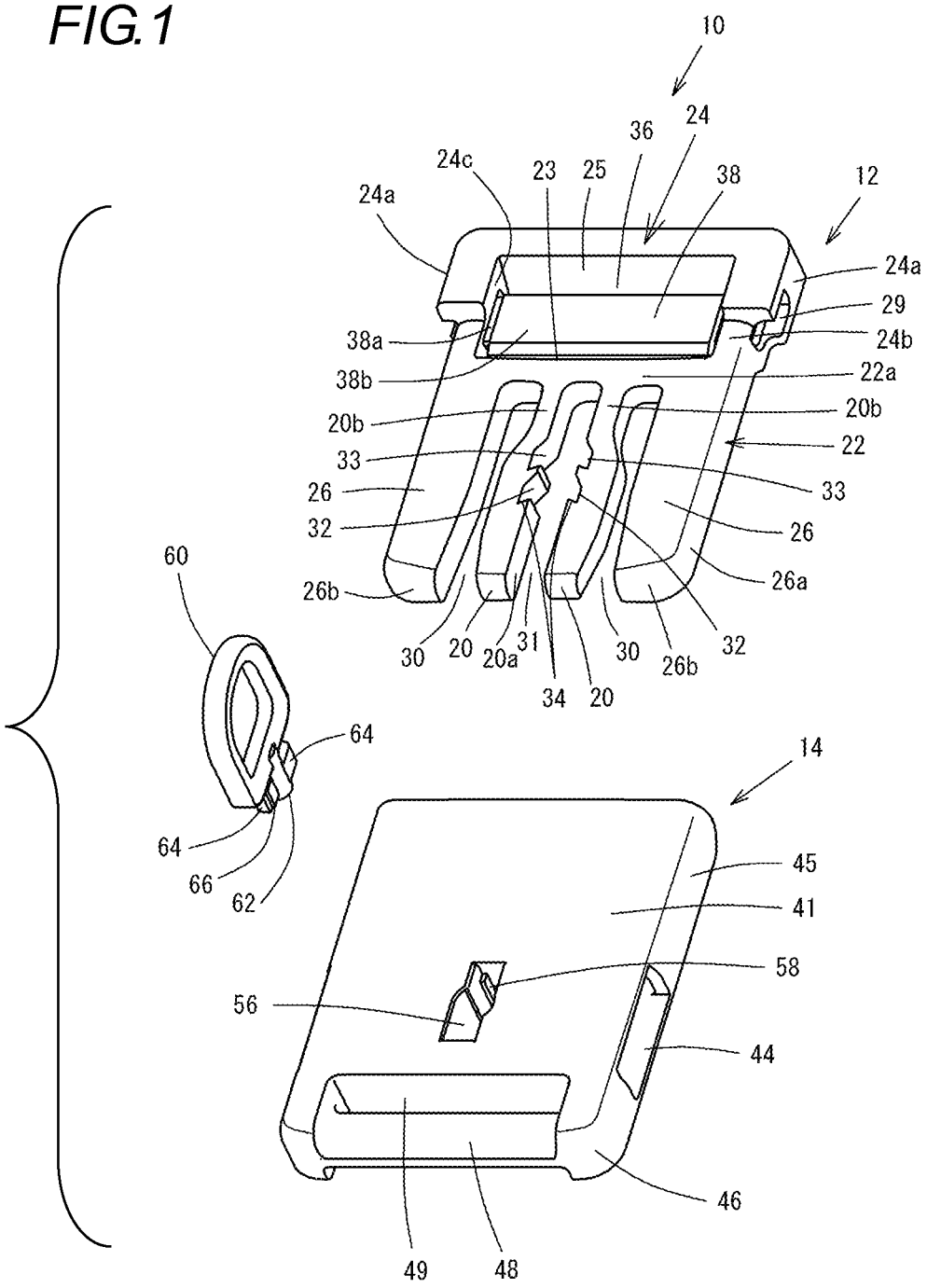
FIG. 1 is a perspective view of a lockable buckle according to a first embodiment of the invention.

Hereinafter, a lockable buckle 10 according to one embodiment of the present invention will be described with reference to FIG. 1 to FIG. 11D. The lockable buckle 10 includes a male member 12 and a female member 14 with which the male member 12 is engaged by fitting. The male member 12 and the female member 14 are respectively attached to members which are freely connected to and disconnected from each other, for example, attached to end portions 16*a* of a belt 16 which is used for tying transport goods or the like. In the following description, a direction in which a pair of engaging portions 20 of the male member 12 which will be described later face each other and move toward and away from each other is referred to as a right and left direction, a direction which intersects perpendicularly the right and left direction and in which the engaging portions 20 protrude is referred to as a front and rear direction, and a direction which intersects perpendicularly the right and left direction and the front and rear direction is referred to as a front and back direction.

Figure 2A:
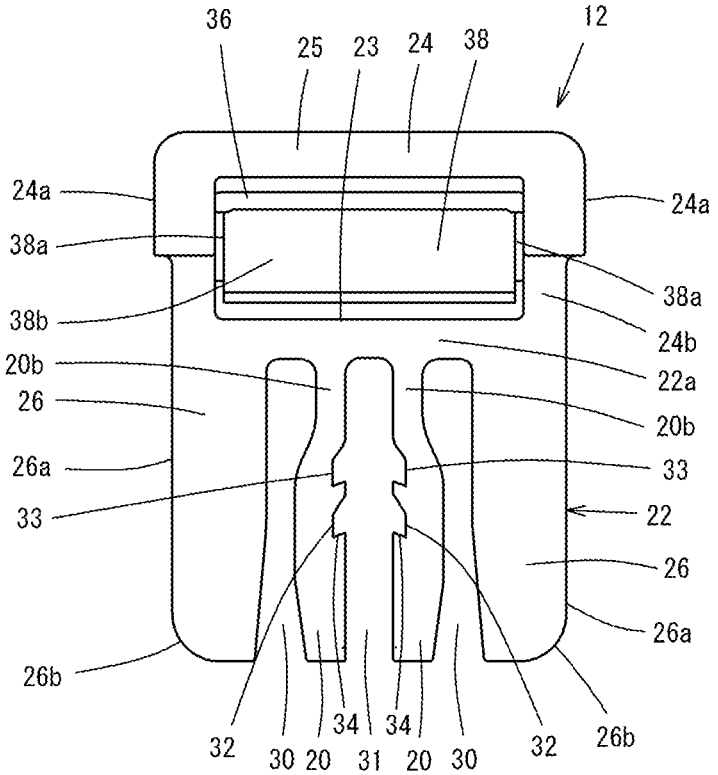
FIG. 2A is a front view of the male member of the lockable buckle according to the first embodiment of the invention.
Figure 2B:
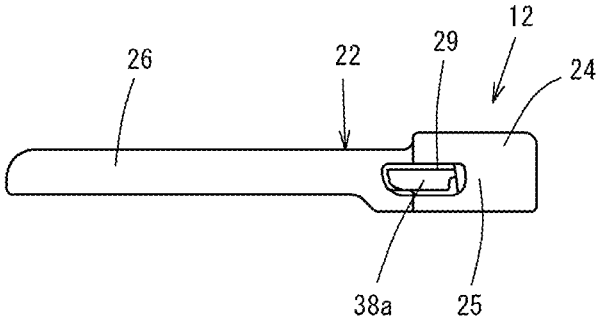
FIG. 2B is a right side view thereof and FIG. 2C is a vertical cross-sectional view thereof.
Figure 2C:
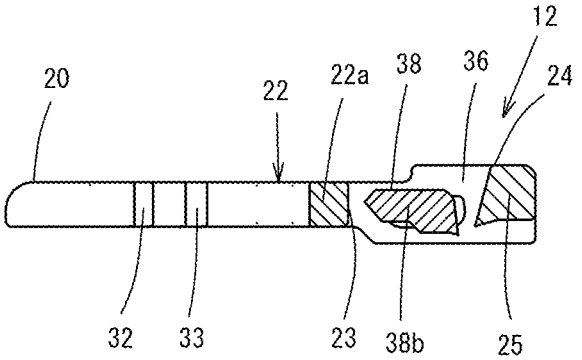
Figure 3A:
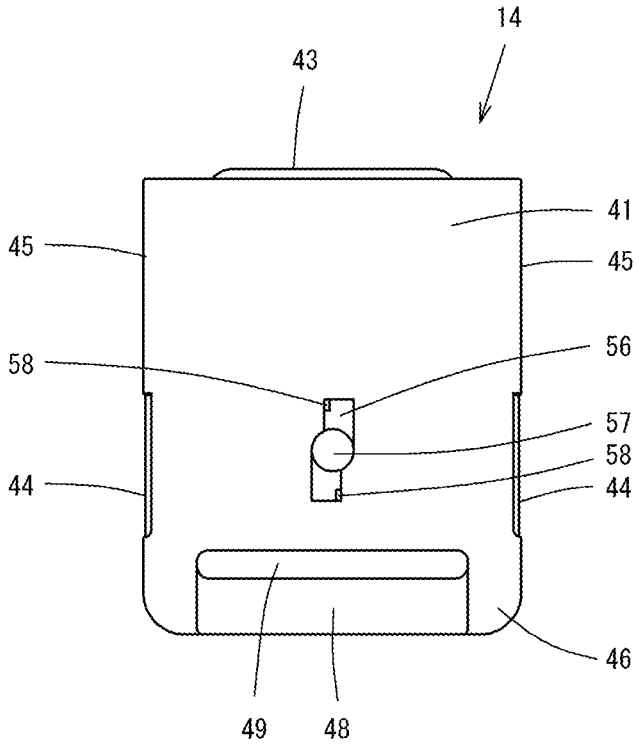
FIG. 3A is a front view of the female member of the lockable buckle according to the first embodiment of the invention and FIG. 3B is a rear view thereof.
Figure 3B:
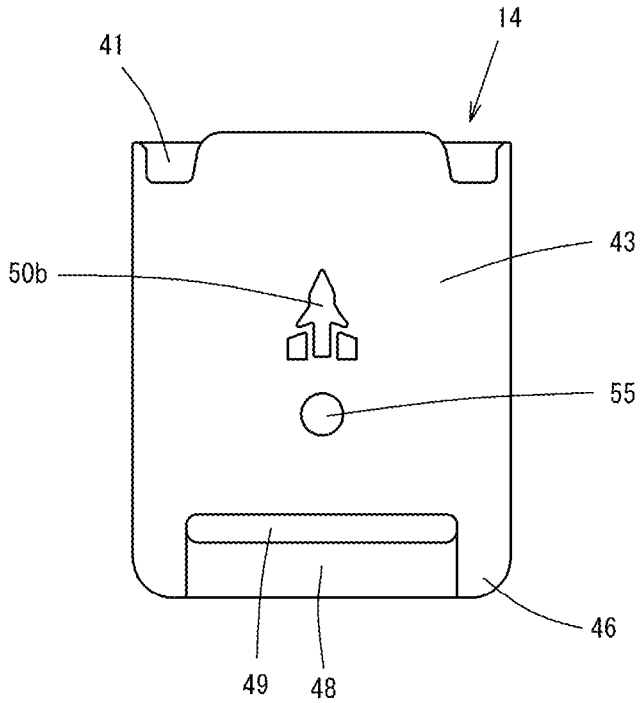
Figure 4:
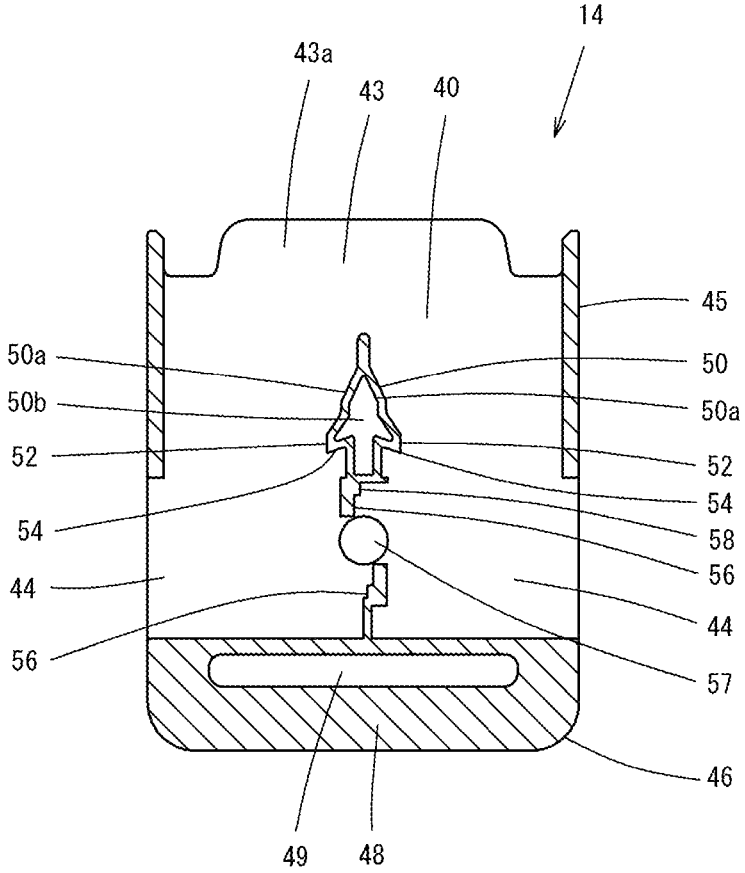
FIG. 4 is a horizontal cross-sectional view of the female member of the lockable buckle according to the first embodiment of the invention.

The male member 12 is made of a synthetic resin, for example, polyacetal, polyamide, polypropylene, or the like, through integral molding. As shown in FIG. 2A or the like, the male member 12 and includes a fitting body 22 which has the shape of a rectangular plate and is fitted into the female member 14 and a belt attachment portion 24 which is formed to integrally continue from the fitting body 22 and to which the belt 16 or the like is attached.

The fitting body 22 has a base end portion 22*a* connected to each of leading end portions 24*b* which protrude from U-shaped side edge portions 24*a* of the belt attachment portion 24. The fitting body 22 includes a pair of guide portions 26 extending from the base end portion 22*a* in the front and rear direction and the pair of engaging portions 20 positioned between the pair of guide portions 26 so as to be substantially parallel to each other. Each of the engaging portions 20 has the shape of a rod, the thickness of which is the same as the thickness of each of the pair of guide portions 26 in the front and back direction. The base end portion 22*a* of the fitting body 22 is positioned slightly more inward than the side edge portions 24*a* of the belt attachment portion 24 in the right and left direction.

Each of the guide portions 26 serves as a portion that prevents the male member 12 from being operated, and extends in the front and rear direction from the base end portion 22*a*. Side edge portions 26*a* at outer sides of the guide portions 26 are formed linear in the front and rear direction. Outer corner portions 26*b* are formed on leading end portions of the side edge portions 26*a* and are rounded to form round portions, which smoothen insertion into the female member 14.

The pair of engaging portions 20 are positioned between the guide portions 26 and extend the same length as the guide portions 26 in the front and rear direction. Space portions 30 and 31 which are elastically deformable are formed between the guide portions 26 and the pair of engaging portions 20 and between the pair of engaging portions 20. Two groove portions 32 and 33 having the same shape are formed in the front and rear direction in each of opposing surfaces 20*a* of the engaging portions 20. Each of the groove portions 32 and 33 has an engagement step 34 at a leading end side, in which claw portions 52 which will be described later is engaged with the engagement step 34. The engagement step 34 is inclined toward the center in the right and left direction of the base end portion 22*a*. A base end portion 20*b* of the engagement portion 20 is formed slightly slimmer than the leading end side such that the base end portion 20*b* can be easily elastically deformed.

The belt attachment portion 24 provided to continue from the base end portion 22*a* of the fitting body 22 has the leading end portions 24*b* which are connected to the base end portion 22*a* of the fitting body 22 and the side edge portions 24*a* which protrude from the leading end portions 24*b* so as to be slightly wider in the front and back direction and the right and left direction. The belt attachment portion 24 continues from the base end portion 22*a* into the shape of a "U." The U-shaped inner space of the belt attachment portion 24 is formed as a belt insertion hole 36 into which the belt 16 is inserted. A side of the belt insertion hole 36 adjacent to the base end portion 22*a* is closed by a side surface of the base end portion 22*a*, a side surface portion of the base end portion 22*a* forms a first cross member 23 along which the belt 16 is inserted, and an inner side surface of the U-shaped belt attachment portion 24 serves as a second cross member 25 along which the belt 16 is inserted.

The belt attachment portion 24 has a movable pivot 38 on which belt 16 is wound inside the belt insertion hole 36 thereof. The movable pivot 38 has protrusions 38*a* at both ends, the protrusions 38*a* being slimmer than a middle portion. A portion of the movable pivot 38 between the protrusions 38*a* forms a winding portion 38*b* on which the belt 16 is wound. The belt attachment portion 24 has shaft holes 29 in opposing inner surfaces 24*c* which are at both sides of the U-shaped structure. The shaft holes 29 respectively extend from the both side edge portions 24*a* to the leading end portions 24*b* and penetrate in the right and left direction. The protrusions 38*a* of the movable pivot 38 are loosely fitted into the shaft holes 29 with a preset movement gap.

The female member 14 is made of a synthetic resin, for example, polyacetal, polyamide, polypropylene, or the like, through integral molding, and is configured as a flat plate-shaped hexahedral box. As shown in FIG. 3A to FIG. 6B, the female member 14 has an accommodation space 40 which can accommodate the fitting body 22 of the male member 12. An opening 42 is formed in one side surface of the hexahedral structure, the entire area of the first side surface being open. The accommodation space 40 is a relatively-flat space, has a front surface portion 41 and a back surface portion 43 which define the accommodation space 40, and is surrounded by side surface portions 45 excluding the opening 42. The side surface portions 45 also serve as operation preventing portions that prevent the engaging portions 20 from being operated from the outside. In a pair of side surfaces that are perpendicular to the opening 42 and have planes in the thickness direction, mold release holes 44 which communicate with the accommodation space 40 are formed in end portions that are positioned away from the opening 42. The mold release holes 44 are holes with which a mold used for molding the female member 14 is released. An attachment portion 46 to which one end of the belt member 16 is attached is formed on the surface that faces the opening 42. The attachment portion 46 includes a belt winding portion 48 on which the belt 16 is wound and a belt insertion hole 49 into which the belt 16 is inserted.

A hollow engaged portion 50 which has a substantially arrow-shaped cross-section is provided substantially in the central portion of the front and back surfaces of the female member 14. The hollow engaged portion 50 is formed to connect the front surface portion 41 to the back surface portion 43 of the female member 14. A hollow portion 50*b* penetrates through the back surface portion 43. The engaged portion 50 has a pair of claw portions 52 perpendicular to the front and back direction. The claw portions have the same cross-sectional shape, are engaged with the groove portions 32 and 33 of the engaging portions 20 of the male member 12, and protrude in the right and left direction. The claw portions 52 have inclined surfaces that face in the direction toward the center of the opening 42. Inclined surface 54 of the claw portions 52 at a side of the attachment portion 46 respectively face the engagement steps 34 formed in the groove portions 32 and 33 of the engaging portion 20 in an engageable manner.

A key member insertion hole 56 and a key shaft hole 57 into which a key member 60 is inserted are formed between the engaged portion 50 and the attachment portion 46 of the female member 14 so as to face the front surface portion 41 and the back surface portion 43 which define the accommodation space 40. Convex portions 58 which selectively allow the key member 60 to be inserted are formed on two portions of the key member insertion hole 56 at a side of the engaged portion 50 and at a side of the belt winding portion 48 so as to be rotationally symmetrical about the key member insertion hole 56. The positions of the convex portions 58 vary depending on the key member 60, and thus connection and disconnection can be enabled by a preset key member 60.

Figure 9:
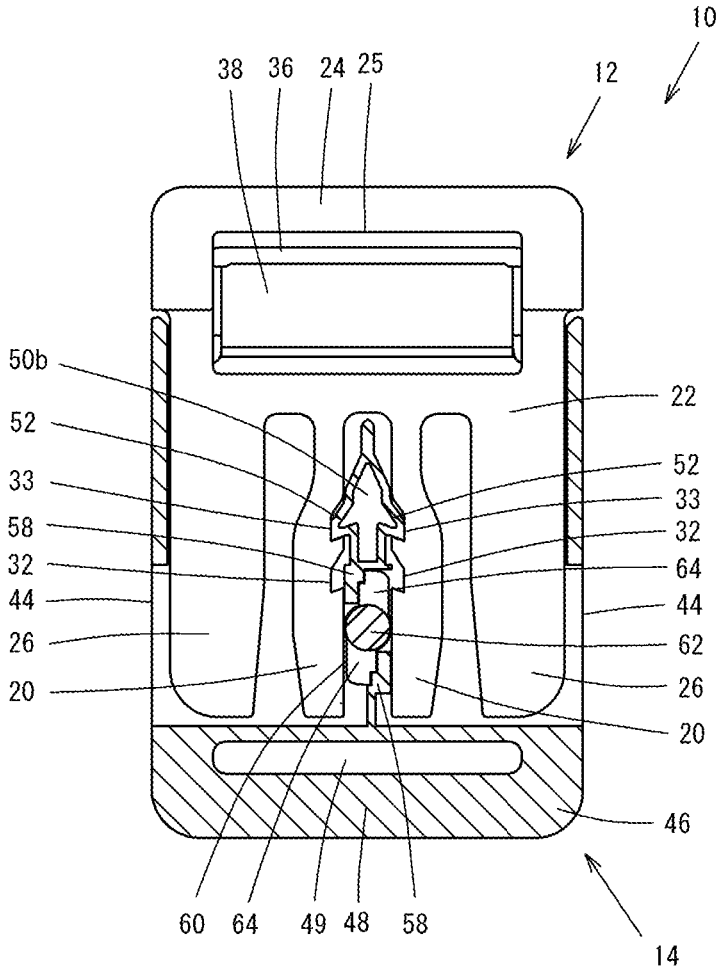
FIG. 9 is a partial horizontal cross-sectional view of the engaged state of the lockable buckle according to the first embodiment.
Figure 11A:
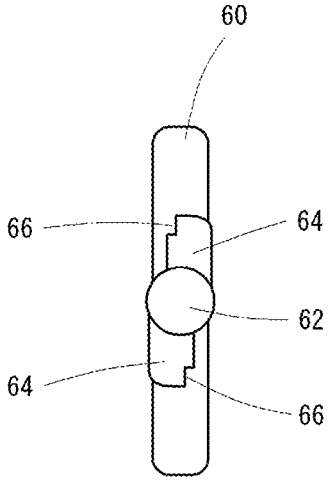
FIG. 11A is a bottom view of the key member of the lockable buckle according to the first embodiment and FIG. 11B to FIG. 11D are bottom views of the key member of the lockable buckle according to modified embodiments.
Figure 11B:
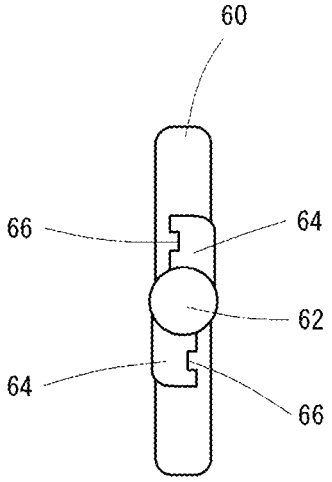
Figure 11C:
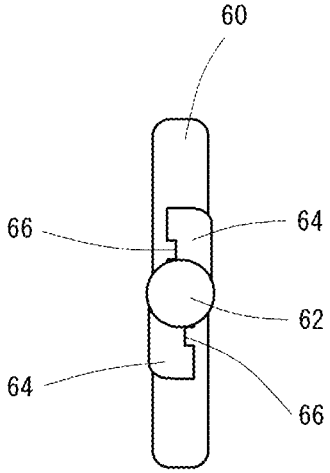
Figure 11D:
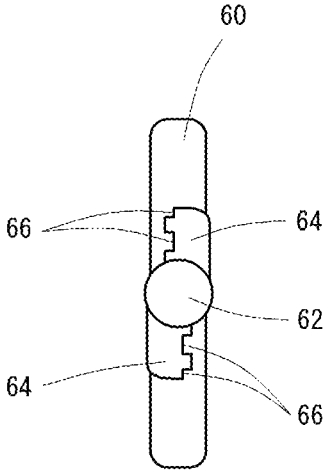

The key member 60 according to the foregoing embodiment has a cylindrical shaft 62, a pair of insertion piece portions 64 which are formed on the shaft 62 so as to be rotationally symmetrical to each other, and concave portions 66 which are formed in the insertion piece portions 64. The convex portions 58 of the engaged portion 50 which are provided inside the accommodation space 40 of the female member 14 are selectively fitted into the concave portions 66. The positions of the convex portions 58 of the engaged portion 50 vary depending to the types of the key member 60. For instance, four types of key members 60 are shown in FIG. 11A to FIG. 11D. Referring to the positions of the concave portions 66 in the insertion piece portions 64, when the concave portions 66 are formed in end portions of the insertion piece portions 64 shown in FIG. 11A, the convex portions 58 of the engaged portion 50 are respectively formed at corresponding end positions, as shown in FIG. 9 or the like. Likewise, when the concave portions 66 are formed in the central portions of the insertion piece portions 64 shown in FIG. 11B, the convex portions 58 of the engaged portion 50 are respectively formed on corresponding central portions. When the concave portions 66 are formed at central sides of the insertion piece portions 64 shown in FIG. 11C, the convex portions 58 of the engaged portion 50 are also respectively formed on corresponding central sides. In addition, as shown in FIG. 11D, when a plurality of concave portions 66 are respectively formed in the insertion piece portions 64, a plurality of convex portions 58 of the engaged portion 50 are respectively formed at corresponding positions.

Figure 7A:
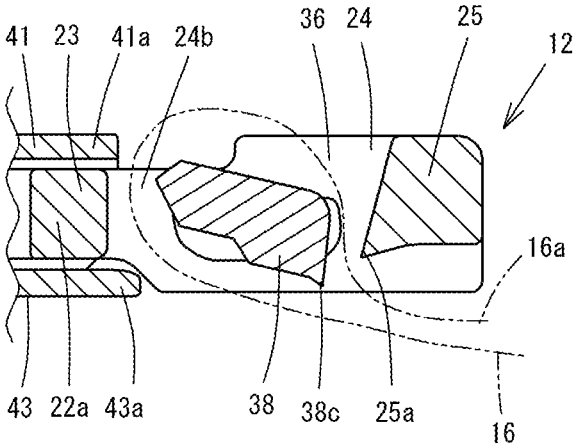
FIG. 7A is a partial vertical cross-sectional view of the belt attachment portion of the first embodiment at the first step of engagement and FIG. 7B is a partial cross-sectional view of the belt attachment portion of the first embodiment at the second step of engagement.
Figure 7B:
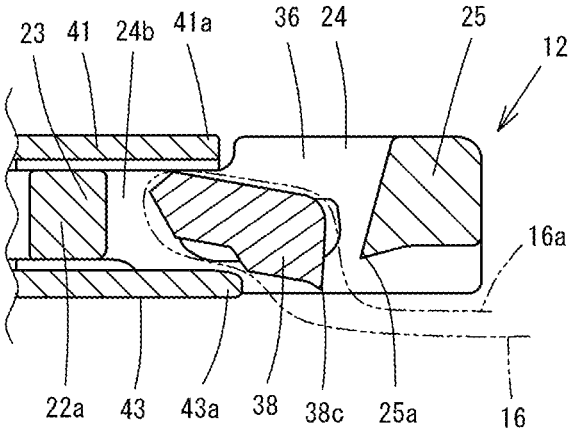

Reference will now be made to a method of using the lockable buckle 10 according to this embodiment. First, a method of attaching the belt 16 to the male member 12 of the lockable buckle 10 will be described. As shown in FIG. 7A and FIG. 7B, the belt 16 is attached to the male member 12 by winding the end portion 16*a* of the belt 16 on the winding portion 38*b* of the movable pivot 38 of the belt attachment portion 24 before the male member 12 is fitted into the female member 14. As for the winding direction, the end portion 16*a* of the belt 16 is inserted into the insertion hole 36 of the male member 12 from the back side, is passed between the movable pivot 38 and the first cross member 23 which is the base end portion 22*a* of the fitting member 22, and then is inserted between the movable pivot 38 and the second cross member 25 which is the edge portion of the belt attachment portion 24 so that the surface of the belt 16 is folded on itself. The end portion 16*a* is pulled in order to adjust the length of the belt 16. Since the protrusions 38*a* of the movable pivot 38 are loosely fitted into the shaft holes 29, the movable pivot 38 moves slightly in the front and rear direction and the front and back direction, as shown in FIG. 7A. When the end portion 16*a* of the belt 16 is pulled, a force is applied in the direction away from the second cross member 25 of the belt attachment portion 24. Consequently, it is possible to pull the end portion 16*a* by sliding it. Referring to the connection of the female member 14 to the other belt which is not shown, one end portion of the other belt is inserted into the belt insertion hole 49 of the female member 14, is wound on the belt winding portion 48, and is fixed to the other end portion of the belt so that the length of the other belt is not adjustable.

Figure 5A:
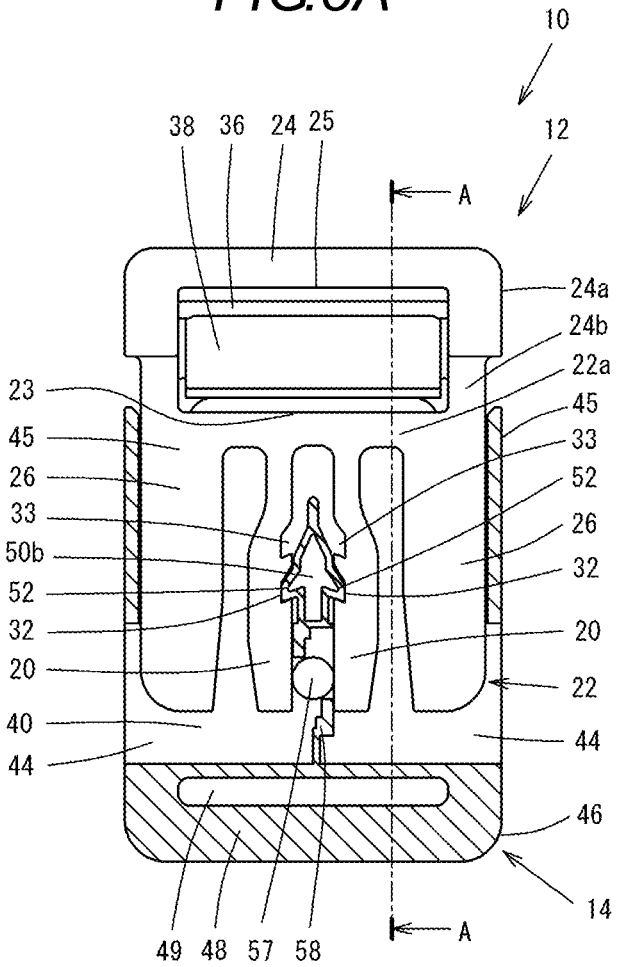
FIG. 5A is a partial cross-sectional view of the lockable buckle according to the first embodiment at a first step of engagement and FIG. 5B is a cross-sectional view along line A-A in FIG. 5A.

Connecting the male member 12 and the female member 14 to each other is carried out in two steps, corresponding to the groove portions 32 and 33 at two portions of the engaging portions 20, as shown in FIG. 5A to FIG. 6B. When the fitting body 22 of the male member 12 is inserted into the accommodation space 40 of the female member 14, the space portion 31 between the engaging portions 20 adjoin to guide inclined surfaces 50*a* of the arrow-shaped engaged portion 50. As the fitting body 22 is pushed inward, the gap between the right and left engaging portions 20 is increased so that the claw portions 52 are sandwiched by the side surfaces 20*a* at inner sides of the leading end portions of the engaging portions 20. When the fitting body 22 of the male member 12 is pushed further inward, the claw portions 52 are fitted into the groove portions 32 at a leading end side of the engaging portions 20, as shown in FIG. 5A and FIG. 5B. Accordingly, the first step of engagement is completed.

Figure 5B:
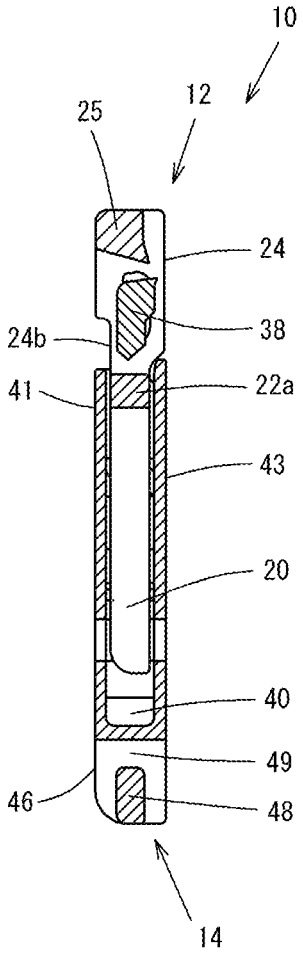

In the state shown in FIG. 5A and FIG. 5B, the male member 12 and the female member 14 are reliably connected to each other so as not to be easily disengaged from each other when the belt 16 is pulled. The length of the belt 16 is adjusted to make the belt 16 tight by pulling the end portion 16*a* of the belt 16 from the belt attachment portion 24 of the male member 12. At this time also, when the end portion 16*a* of the belt 16 is pulled, the winding portion 38*b* of the movable pivot 38 is pushed by the end portion 16*a* of the belt 16 so as to be separated from the second cross member 25 of the belt attachment portion 24 so that the end portion 16*a* can slide. When tension applied to the belt 16 is increased in response to the pulling of the end portion 16*a*, the belt 16 applies a force with which the movable pivot 38 is compressed against the cross member 25. Here, a corner portion 25*a* of the second cross member 25 and a corner portion 38*c* of the movable pivot 38 can come into strong contact with the surface of the belt 16 so that the belt 16 is sandwiched, thereby reliably fixing the end portion 16*a* of the belt 16 so as not to slide.

Figure 6A:
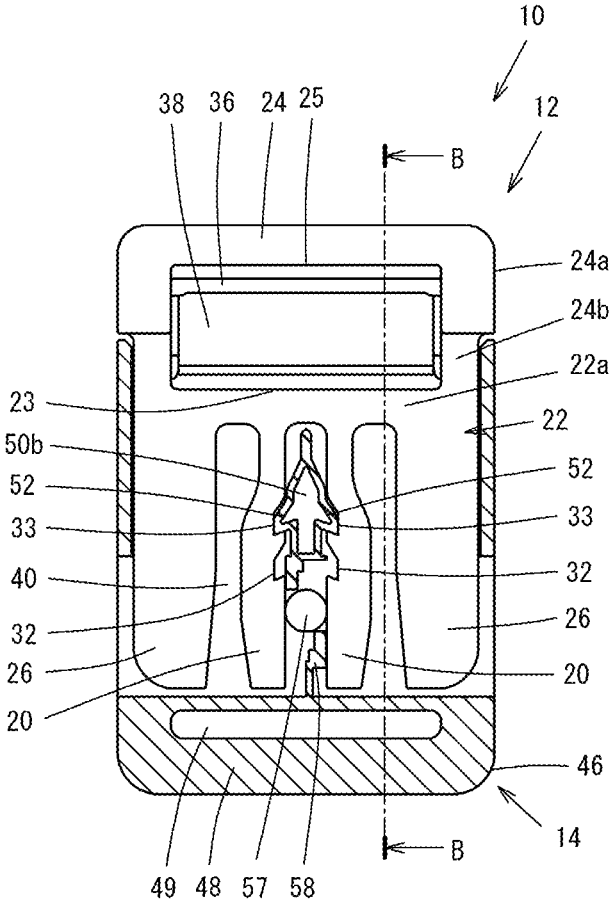
FIG. 6A is a partial cross-sectional view of the lockable buckle according to the first embodiment at a second step of engagement and FIG. 6B is a cross-sectional view along line B-B in FIG. 6A.
Figure 6B:
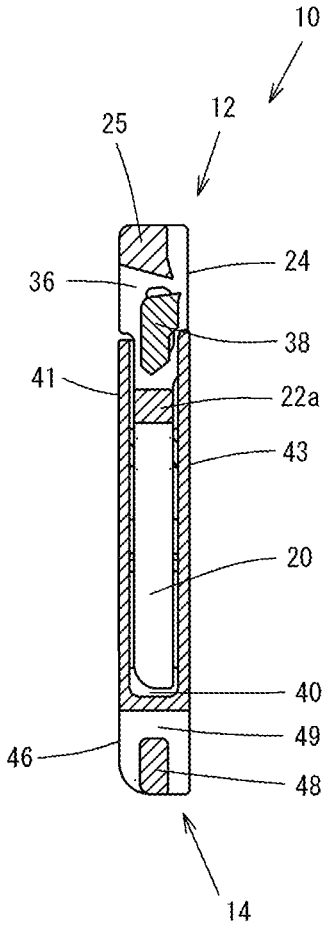

Afterwards, when the male member 12 is pushed further into the female member 14, the gap between the engaging portions 20 increased by the guide inclined surfaces 50*a* of the engaged portion 50, and the engaging portions 20 are pressed against the claw portions 52 while climbing the claw portions 52. As shown in FIG. 6A and FIG. 6B, the claw portions 52 are fitted into the groove portions 33 that are at a side of the base end portion 22*a*, i.e. a base end side of the engaging portions 20, thereby completing the second step of engagement. Also in this state, the male member 12 and the female member 14 are robustly connected to each other such that it is impossible to pull out the male member 12 from the female member 14. Due to this, retightening of the belt 16 is carried out. In addition, since the engaging portions 20 are positioned between the guide portions 26 and accommodated inside the female member 14, it is impossible to disengage the engaging portions 20 from the claw portions 52 by pushing and expanding the engaging portions 20 without using the key member 60 from the outside. Although the mold release holes 44 are formed in the side surfaces of the female member 14, it is impossible to adjust the engaging portions 20 through the mold release holes 44 since the side edge portions 26*a* of the guide portions 26 are positioned so as to close the entire area of the mold release holes 44.

Figure 8A:
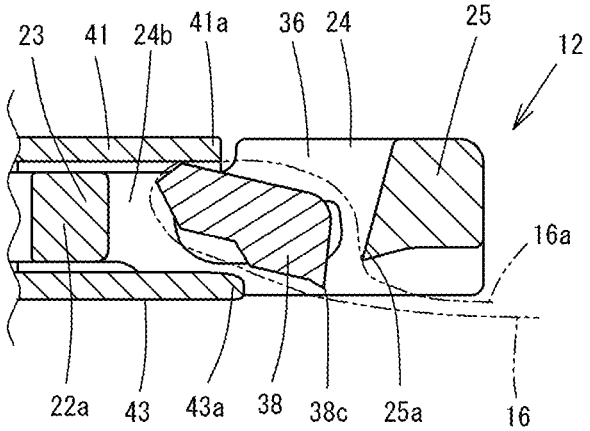
FIG. 8A is a partial vertical cross-sectional view showing a state in which the belt is fixed by the belt attachment portion of the lockable buckle according to the first embodiment and FIG. 8B is a partial vertical cross-sectional view showing another state in which the belt is fixed by the belt attachment portion of the lockable buckle according to the first embodiment.
Figure 8B:
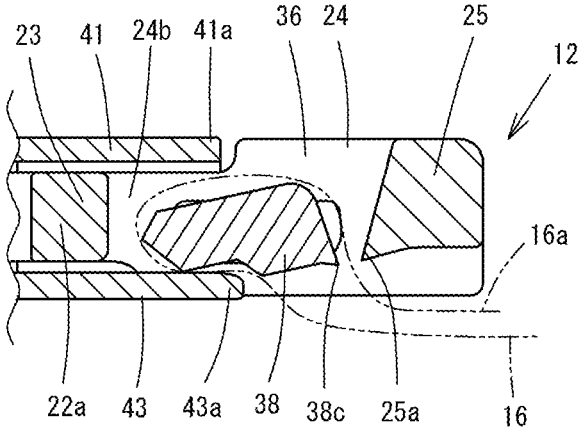

As shown in FIG. 7B, edge portions 41*a* and 43*a* of the front and back surface portions 41 and 43 of the female member 14 at a side of the opening 42 are positioned to cover substantially the half of the movable pivot 38 of the belt attachment portion 24 from the base end portion 22*a* of the fitting body 22 of the male member 12. The belt 16 and the movable pivot 38 are reliably protected, and an inadvertent external force does not act on the belt 16. In particular, in the first step of engagement in which the claw portions 52 are fitted into the groove portions 32 of the engaging portions 20, the edge portions 41*a* and 43*a* of the front and back surface portions 41 and 43 are not covered with the belt attachment portion 24 of the male member 12, as shown in FIG. 5A, FIG. 5B and FIG. 7A. The edge portion 41*a* is caught slightly by the movable pivot 38 of the belt attachment portion 24, and the edge portion 43*a* is not caught by the movable pivot 38. Afterwards, in the second step of engagement in which the claw portions 52 are fitted into the groove portions 33 of the engaging portion 20, a part of an outer portion of the movable pivot 30 at a side of the fitting body 22 is positioned to be covered with both sides of the edge portions 41*a* and 43*a* and parts of the front and back surfaces of the movable pivot 38 are covered with the edge portions 41*a* and 43*a*, as shown in FIG. 6A, FIG. 6B, FIG. 7B, FIG. 8A and FIG. 8B. Accordingly, even though a force of pulling the end portion 16*a* of the belt 16 acts, the movable pivot 38 moves slightly toward the edge portion 41*a* of the front surface portion 41 so that the movement of the movable pivot 38 is suppressed, as shown in FIG. 8A, and the belt 16 is sandwiched in this state. This consequently prevents the belt 16 from being loosened. Likewise, when tension is applied from a base end side of the belt 16 wound on the movable pivot 38, the movable pivot 38 moves slightly toward the edge portion 43*a* so that the movement of the movable pivot 38 is suppressed, as shown in FIG. 8B, and the belt 16 is sandwiched in this state. This consequently prevents the belt 16 from being loosened.

Figure 10A:
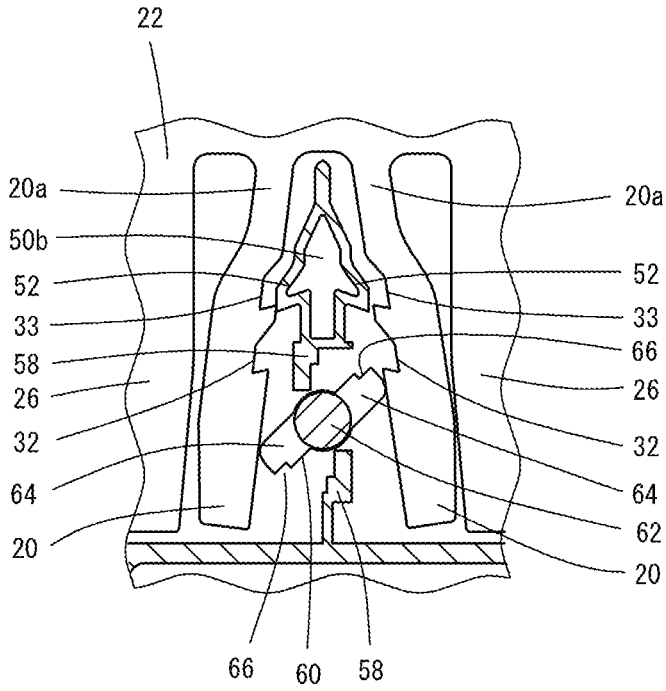
FIG. 10A is a partially enlarged cross-sectional view of the lockable buckle according to the first embodiment while engagement is being released and FIG. 10B is a partial enlarged cross-sectional view of the lockable buckle according to the first embodiment after the engagement is released.
Figure 10B:
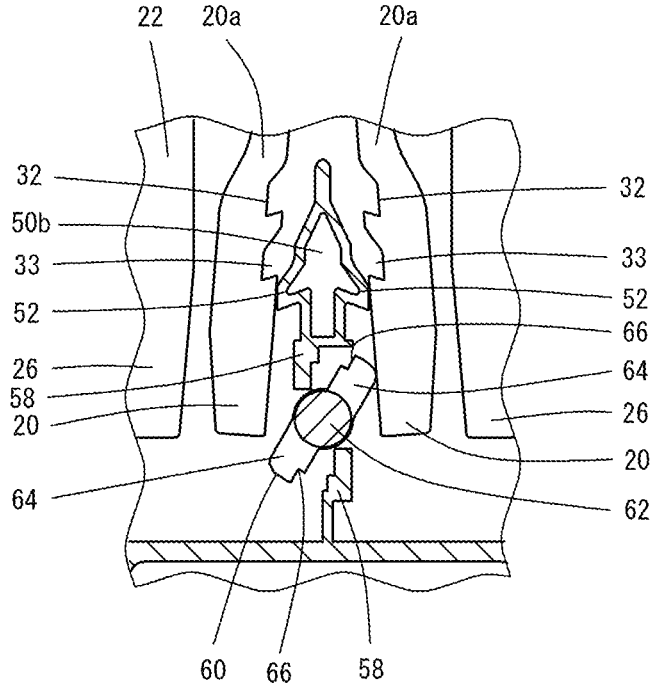

In subsequence, in order to release the connection between the male member 12 and the female member 14 of the lockable buckle 10, the key member 60 is inserted into the key member insertion hole 56, as shown in FIG. 9, and the key member 60 is rotated clockwise, as shown in FIG. 10A. Then, the insertion piece portions 64 of the key member 60 elastically deform the right and left engaging portions 20 of the male member 12 so that the gap between the engaging portions 20 is increased, thereby releasing the engagement between the groove portions 33 of the engaging portions 20 and the claw portions 52 of the engaged portion 50. When the engagement is released, due to the inclination in the state in which both ends of the insertion piece portions 64 and the side surfaces 20*a* of the engaging portions 20 and an elastic repulsive force caused by the elastic deformation of the engaging portions 20, a partial force in the direction of pushing the male member 12 from the female member 14 acts on the engaging portions 20. This force pushes the male member 12 out of the female member 14. When the male member 12 is pushed smoothly by a preset amount of pushing force or greater, the engaging portions 20 jump from the position where the groove portions 33 are engaged with the claw portions 52 of the engaged portion 50 over the next groove portions 32 so that the male member 12 is pushed to the position shown in FIG. 10B. Also in this state, the male member 12 is urged by the elastic repulsive force of the engaging portions 20 in the direction in which the male member 12 is released from the female member 14, so that the male member 12 can be easily pulled out from the female member 14 without resistance.

According to the lockable buckle 10 of this embodiment, a pair of members, i.e. the male member 12 and the female member 14, can form the lockable buckle which can reliably stay in the locked state. In particular, each of the guide portions 26 serves as a portion that prevents the male member 12 from being operated, and the engaging portions 20 are positioned between the guide portions 26 and accommodated inside the female member 14. It is impossible to disengage the engaging portions 20 from the claw portions 52 by pushing and expanding the engaging portions 20 without using the key member 60 from the outside. In addition, the structure can be simple and a thin profile can be realized. Even in the state in which members are fixed using the belt 16, the lockable buckle 10 has a good appearance since it does not significantly protrude from the surface. The members which are tied using the lockable buckle 10 can be safely stacked on each other.

In addition, the groove portions of the engaging portions 20 are prepared in two steps, and the belt 16 can be reliably tightened in the connected state. Consequently, the connected state can be safe, and the operability is good. Furthermore, a part of the movable pivot 38 of the belt attachment portion 24 is covered with the edge portions 41*a* and 43*a* of the front and back surface portions 41 and 43 of the female member 14. Since it is difficult for an inadvertent external force to act, it is possible to more reliably maintain the belt in the fixed state.

Figure 12A:
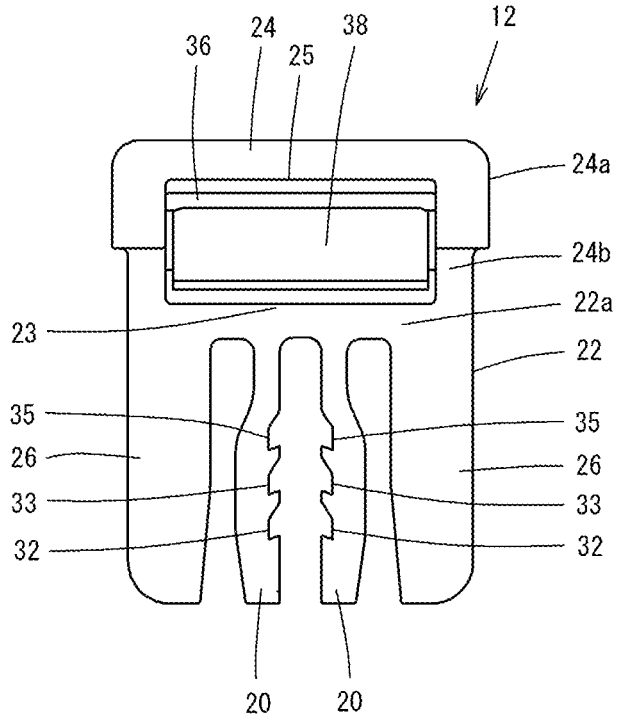
FIGS. 12A and 12B are front views of the male member of the lockable buckle according to modified embodiments of the invention.
Figure 12B:
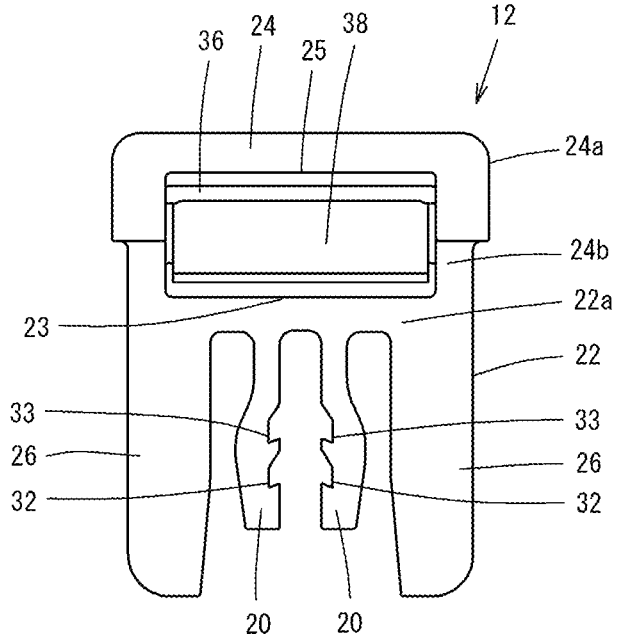

In the meantime, the lockable buckle of the present invention is not limited to the foregoing embodiments, but the male member 12 may be configured such that three groove portions 32, 33 and 35 are formed in the engaging portions 20, as shown in FIG. 12A, and the number of steps of engagement may be suitably set. In addition, as shown in FIG. 12B, the length of the engaging portions 20 may be shorter than the length of the guide portions 26, and neither the length nor the shape is limited. Furthermore, the groove portions of the engaging portions and the claw portions of the engaged portion may be respectively provided by exchanging positions, be formed so as to be engageable and disengageable so that the connected state can be maintained. Furthermore, the groove portions and the claw portions may be configured so as to be engaged with and disengaged from each other such that the connected state can be maintained.

Figure 13:
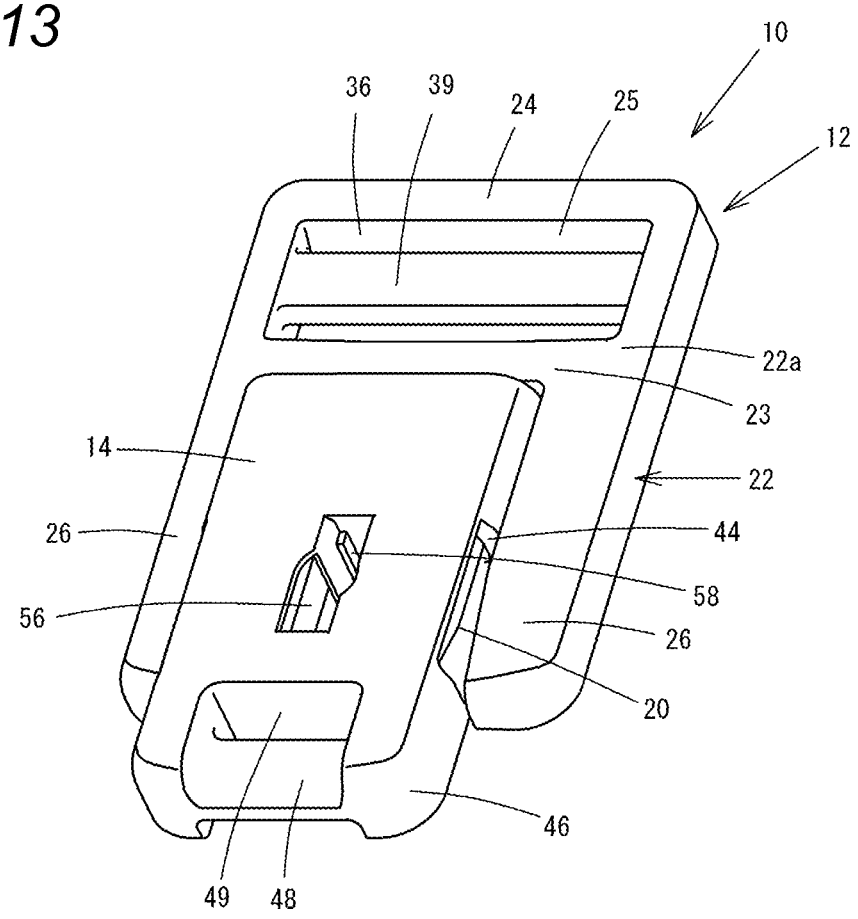
FIG. 13 is a perspective view showing another modified embodiment of the lockable buckle according to the invention.

In addition, as shown in FIG. 13, the male member 12 may be configured such that only the engaging portions 20 are fitted into the accommodation space 40 of the female member 14. The thickness and width of the belt attachment portion 24 of the male member 12 are the same as those of the fitting body 22, and the front and back surfaces of the belt attachment portion 24 are flush. In the belt insertion hole 36, a fixing pivot 39 on which the belt 16 is wound is provided integrally with the belt attachment portion 24. An accommodation space of the female member 14 is formed in a size that covers only the engaging portions 20 of the male member 12 but does not cover the base end portion 22*a* of the fitting body 22. Therefore, this is not configured such that the front and back surface portions 41 and 43 of the accommodation portion 40 extend to the belt attachment portion 24 in order to limit the movement of the movable pivot 38 of the belt attachment portion 24 as in the foregoing embodiment. This structure can also reliably maintain the engagement between the male member 12 and the female member 14, prevent the engagement from being released from the outside, and thus safely maintain the engaged state. In addition, it is possible to reduce the size of the female member 14.

What is claimed is:

1. A lockable buckle comprising a male member, a female member and a key member, the male member and the female member being connectable to and disconnectable from each other, wherein the male member is formed with an attachment portion which is attachable to an external member and engaging portions protruding from the attachment portion, wherein the female member is formed with an attachment portion which is attachable to an external member and an accommodation space which is surrounded by a front surface portion, a back surface portion and side surface portions and configured to accommodate the engaging portions, wherein one end portion of the accommodation space is provided as an opening configured to insert the male member thereinto, wherein an engaged portion configured to engage the engaging portions therewith is provided inside the accommodation space, wherein the front surface portion of the female member is formed with a key member insertion hole communicating with the accommodation space, wherein the key member is configured to be inserted into the accommodation space through the key member insertion hole to abut the engaging portions and to release engagement between the engaging portions and the engaged portion, wherein the key member insertion hole is configured so that a direction in which the key member is inserted into the accommodation space through the key member insertion hole is substantially perpendicular to a direction in which the male member is inserted into the accommodation space through the opening, and wherein the key member is configured to elastically deform the engaging portions to release the engagement between the engaging portions and the engaged portion when the key member inserted into the key member insertion hole pivots.

2. The lockable buckle according to claim 1, wherein the key member comprises insertion piece portions configured to abut the engaging portions when the key member pivots to push and expand the pair of engaging portions in a right and left direction.

3. The lockable buckle according to claim 1, wherein the male member is integrally formed with guide portions positioned outside the engaging portions in an engaged state.

4. The lockable buckle according to claim 3, wherein the engaging portions and the guide portions form a plate-shaped fitting body, the female member is formed into a flat-shape and the accommodation space configured to fit the fitting body thereinto is formed into a flat-shape.

5. A lockable buckle comprising a male member, a female member and a key member, the male member and the female member being connectable to and disconnectable from each other, wherein the male member is formed with an attachment portion which is attachable to an external member and engaging portions protruding from the attachment portion, wherein the female member is formed with an attachment portion which is attachable to an external member and an accommodation space which is surrounded by a front surface portion, a back surface portion and side surface portions and configured to accommodate the engaging portions, wherein one end portion of the accommodation space is provided as an opening configured to insert the male member thereinto, wherein an engaged portion configured to engage the engaging portions therewith is provided inside the accommodation space, wherein the front surface portion of the female member is formed with a key member insertion hole communicating with the accommodation space, wherein the key member is configured to be inserted into the accommodation space through the key member insertion hold to abut the engaging portions and to release engagement between the engaging portions and the engaged portion, wherein the key member is configured to elastically deform the engaging portions to release the engagement between the engaging portions and the engaged portion when the key member inserted into the key member insertion hole is operated, and wherein claw portions of the engaged portion are engageable with groove portions formed in the pair of engaging portions at a side of a leading end portion of the engaging portions and groove portions formed in the engaging portions at a side of a base end portion, so that the male member and the female member are connectable to each other at at least two positions.

6. The lockable buckle according to claim 5, wherein the attachment portion of the male member is a belt attachment portion which is attachable to a belt, and wherein in a state in which the male member is connected to the female member, edge portions of the front surface portion and the back surface portion of the female member covers a part of the belt attachment portion.

7. The lockable buckle according to claim 6, wherein when the male member is connected to the female member at the side of the leading end portion of the engaging portions, the belt attachment portion is not covered with the female member, and wherein when the male member is connected to the female member at the side of the base end portion, the part of the belt attachment portion is covered with the edge portions of the female member.

* * * * *